US008779886B2

(12) United States Patent
Aimi et al.

(10) Patent No.: US 8,779,886 B2
(45) Date of Patent: Jul. 15, 2014

(54) SWITCH STRUCTURES

(75) Inventors: Marco Francesco Aimi, Niskayuna, NY (US); Shubhra Bansal, Niskayuna, NY (US); Christopher Fred Keimel, Schenectady, NY (US); Kuna Venkat Satya Rama Kishore, Bangalore (IN); Sairam Sundaram, Niskayuna, NY (US); Parag Thakre, Bangalore (IN)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 12/627,476

(22) Filed: Nov. 30, 2009

(65) Prior Publication Data

US 2011/0128112 A1 Jun. 2, 2011

(51) Int. Cl.

| | |
|---|---|
| ***H01H 37/00*** | (2006.01) |
| ***H01H 57/00*** | (2006.01) |
| ***H01H 37/46*** | (2006.01) |
| ***H01H 61/00*** | (2006.01) |
| ***H01H 71/18*** | (2006.01) |

(52) U.S. Cl.

USPC ..... 337/298; 337/393; 337/123; 337/139; 200/181

(58) Field of Classification Search

USPC ..... 337/298, 393, 123, 139; 200/181

See application file for complete search history.

(56) References Cited

U.S. PATENT DOCUMENTS 4,423,401 A * 12/1983 Mueller ..... 337/107
4,959,515 A 9/1990 Zavracky et al.
5,258,591 A * 11/1993 Buck ..... 200/181
5,578,976 A * 11/1996 Yao ..... 333/262
5,619,177 A * 4/1997 Johnson et al. ..... 337/140
5,638,946 A * 6/1997 Zavracky ..... 200/181
5,696,619 A 12/1997 Knipe et al.
6,153,839 A * 11/2000 Zavracky et al. ..... 200/181
6,307,169 B1 10/2001 Sun et al.

(Continued)

FOREIGN PATENT DOCUMENTS

| | | |
|---|---|---|
| CN | 1613128 A | 5/2005 |
| CN | 101533740 A | 9/2009 |
| EP | 2073236 A1 | 6/2009 |

OTHER PUBLICATIONS

Liu, "High Performance RF MEMS Series Contact Switch—Design and Simulations", Freescale Semiconductor, Electronic Components and Technology Conference, Tempe, Arizona, pp. 158-164, May 29-Jun. 1, 2007.

(Continued)

*Primary Examiner* — Bradley Thomas
(74) *Attorney, Agent, or Firm* — Robert M. McCarthy

(57) ABSTRACT

A device, such as a switch structure, is provided. The switch structure can include a contact and a conductive element each respectively disposed on a substrate. The conductive element can be composed substantially of metallic material, and can be configured to be deformable between a first position, in which the conductive element is separated from the contact by a separation distance, and a second position, in which the conductive element contacts the contact and stores mechanical energy. The conductive element can be further configured such that, subsequent to being deformed into the second position at a temperature between about room temperature and about half of a melting temperature of the metallic material for a cumulative time of at least $10^7$ seconds, the separation distance in the absence of external forces varies by less than 20 percent over the cumulative time. Associated methods are also provided.

27 Claims, 8 Drawing Sheets

(56) References Cited

U.S. PATENT DOCUMENTS

| | | | | |
|---|---|---|---|---|
| 6,310,339 | B1 * | 10/2001 | Hsu et al. | 250/214.1 |
| 6,373,007 | B1 | 4/2002 | Calcatera et al. | |
| 6,384,353 | B1 * | 5/2002 | Huang et al. | 200/181 |
| 6,384,707 | B2 * | 5/2002 | Minners | 337/139 |
| 6,396,368 | B1 * | 5/2002 | Chow et al. | 333/262 |
| 6,570,750 | B1 | 5/2003 | Calcatera et al. | |
| 6,625,004 | B1 * | 9/2003 | Musolf et al. | 361/278 |
| 6,667,245 | B2 * | 12/2003 | Chow et al. | 438/723 |
| 6,703,916 | B2 * | 3/2004 | Charvet et al. | 337/141 |
| 6,720,851 | B2 * | 4/2004 | Hallbjorner et al. | 335/78 |
| 6,731,492 | B2 * | 5/2004 | Goodwin-Johansson | 361/233 |
| 6,746,891 | B2 | 6/2004 | Cunningham et al. | |
| 6,768,412 | B2 * | 7/2004 | Becka et al. | 337/36 |
| 6,787,438 | B1 * | 9/2004 | Nelson | 438/584 |
| 6,788,175 | B1 | 9/2004 | Prophet | |
| 6,794,101 | B2 * | 9/2004 | Liu et al. | 430/48 |
| 6,800,912 | B2 * | 10/2004 | Ozgur | 257/414 |
| 6,803,755 | B2 | 10/2004 | Herbert et al. | |
| 6,842,097 | B2 * | 1/2005 | Hsu et al. | 335/78 |
| 6,876,283 | B1 | 4/2005 | Weber et al. | |
| 6,876,482 | B2 | 4/2005 | DeReus | |
| 6,882,264 | B2 * | 4/2005 | Cunningham | 337/139 |
| 6,924,966 | B2 * | 8/2005 | Prophet | 361/207 |
| 7,126,220 | B2 * | 10/2006 | Lahiri et al. | 257/734 |
| 7,230,513 | B2 * | 6/2007 | Chou | 333/262 |
| 7,372,348 | B2 * | 5/2008 | Xu et al. | 335/78 |
| 7,471,184 | B1 * | 12/2008 | Aksyuk et al. | 337/1 |
| 7,609,136 | B2 | 10/2009 | Wang et al. | |
| 7,782,170 | B2 * | 8/2010 | Robert | 337/85 |
| 7,812,703 | B2 | 10/2010 | Carlson et al. | |
| 8,349,258 | B2 * | 1/2013 | Xu et al. | 422/68.1 |
| 2001/0010488 | A1 * | 8/2001 | Minners | 337/131 |
| 2002/0027487 | A1 * | 3/2002 | Suzuki | 333/262 |
| 2002/0097133 | A1 * | 7/2002 | Charvet et al. | 337/27 |
| 2003/0034870 | A1 * | 2/2003 | Becka et al. | 337/36 |
| 2003/0058069 | A1 * | 3/2003 | Schwartz et al. | 335/78 |
| 2003/0116417 | A1 * | 6/2003 | DeReus | 200/181 |
| 2003/0137389 | A1 * | 7/2003 | Weaver et al. | 337/36 |
| 2004/0061579 | A1 * | 4/2004 | Nelson | 335/78 |
| 2005/0046541 | A1 * | 3/2005 | Fouillet | 337/333 |
| 2005/0183938 | A1 * | 8/2005 | Chou | 200/181 |
| 2005/0219016 | A1 * | 10/2005 | Chou et al. | 335/78 |
| 2006/0131150 | A1 * | 6/2006 | Yuba et al. | 200/329 |
| 2007/0009197 | A1 * | 1/2007 | Poland et al. | 385/12 |
| 2007/0222004 | A1 | 9/2007 | Carlson et al. | |
| 2008/0017489 | A1 * | 1/2008 | Kawakubo et al. | 200/181 |
| 2008/0061913 | A1 * | 3/2008 | Rubel | 335/220 |
| 2008/0087530 | A1 | 4/2008 | Paranjpye et al. | |
| 2008/0088899 | A1 * | 4/2008 | Kamins et al. | 359/196 |
| 2008/0283374 | A1 * | 11/2008 | Naito | 200/181 |
| 2009/0020399 | A1 * | 1/2009 | Kim et al. | 200/181 |
| 2009/0127082 | A1 * | 5/2009 | Zhang et al. | 200/181 |
| 2010/0018843 | A1 * | 1/2010 | Aimi et al. | 200/181 |
| 2010/0155203 | A1 * | 6/2010 | Wang et al. | 200/181 |
| 2010/0252403 | A1 * | 10/2010 | Hays et al. | 200/181 |
| 2010/0255322 | A1 * | 10/2010 | Den Toonder et al. | 428/457 |
| 2010/0263997 | A1 * | 10/2010 | Hilgers | 200/181 |
| 2011/0006874 | A1 * | 1/2011 | Becker et al. | 337/382 |
| 2011/0036690 | A1 * | 2/2011 | Wang et al. | 200/181 |
| 2011/0067983 | A1 * | 3/2011 | Keimel et al. | 200/181 |
| 2011/0094861 | A1 * | 4/2011 | Feng et al. | 200/181 |
| 2011/0140546 | A1 * | 6/2011 | Gowda et al. | 307/139 |
| 2011/0163397 | A1 * | 7/2011 | Detor et al. | 257/415 |

OTHER PUBLICATIONS

Kohn et al., "Diamond High Speed and High Power MEMS Switches", Institute of Electron Devices and Circuits, University of Ulm, Germany, 4th EMRS DTC Technical Conference, Edinburgh, 6 pages, 2007.

European Search Report dated Feb. 21, 2011.

Unofficial English translation of Office Action issued in connection with corresponding CN Application No. 201010586673.1 on Mar. 3, 2014.

* cited by examiner

SWITCH STRUCTURES

BACKGROUND

Embodiments of the invention relate generally to devices for switching current, and more particularly to microelectromechanical switch structures.

A circuit breaker is an electrical device designed to protect electrical equipment from damage caused by faults in the circuit. Traditionally, many conventional circuit breakers include bulky (macro-)electromechanical switches. Unfortunately, these conventional circuit breakers are large in size may necessitate use of a large force to activate the switching mechanism. Additionally, the switches of these circuit breakers generally operate at relatively slow speeds. Furthermore, these circuit breakers can be complex to build and thus expensive to fabricate. In addition, when contacts of the switching mechanism in conventional circuit breakers are physically separated, an arc can sometimes form therebetween, which arc allows current to continue to flow through the switch until the current in the circuit ceases. Moreover, energy associated with the arc may seriously damage the contacts and/or present a burn hazard to personnel.

As an alternative to slow electromechanical switches, relatively fast solid-state switches have been employed in high speed switching applications. These solid-state switches switch between a conducting state and a non-conducting state through controlled application of a voltage or bias. However, since solid-state switches do not create a physical gap between contacts when they are switched into a non-conducting state, they experience leakage current when nominally non-conducting. Furthermore, solid-state switches operating in a conducting state experience a voltage drop due to internal resistances. Both the voltage drop and leakage current contribute to power dissipation and the generation of excess heat under normal operating circumstances, which may be detrimental to switch performance and life. Moreover, due at least in part to the inherent leakage current associated with solid-state switches, their use in circuit breaker applications is not possible.

Micro-electromechanical system (MEMS) based switching devices may provide a useful alternative to the macro-electromechanical switches and solid-state switches described above for certain current switching applications. MEMS-based switches tend to have a low resistance when set to conduct current, and low (or no) leakage when set to interrupt the flow of current therethrough. Further, MEMS-based switches are expected to exhibit faster response times than macro-electromechanical switches.

BRIEF DESCRIPTION

In one aspect, a device, such as a switch structure, is provided. The switch structure can include a contact and a conductive element each respectively disposed on a substrate. The conductive element can be composed substantially of metallic material, and can be configured to be deformable between a first position, in which the conductive element is separated from the contact by a separation distance, and a second position, in which the conductive element contacts (and, in some cases, establishes electrical communication with) the contact and stores mechanical energy (e.g., mechanical energy sufficient to cause the conductive element to substantially assume the first position in the absence of external forces). For example, the conductive element can include a cantilever, a fixed-fixed beam, a torsional element, and/or a diaphragm. The switch structure may include an electrode disposed on the substrate and configured to be charged so as to apply an electrostatic force configured to urge the conductive element toward the second position.

The conductive element can be further configured such that, subsequent to being deformed into the second position at a temperature between about room temperature and about half of a melting temperature of the metallic material for a cumulative time of at least $10^7$ seconds, the separation distance in the absence of external forces varies by less than 20 percent over the cumulative time. The conductive element can include an anchor extending from the substrate and a beam having an end coupled to the anchor so as to be cantilevered therefrom. The beam and the anchor can define therebetween an angle, and the conductive element can be configured such that, subsequent to being deformed into the second position at a temperature between about room temperature and about half of a melting temperature of the metallic material for a cumulative time of at least $10^7$ seconds, the angle in the absence of external forces varies by less than 0.1 percent. Additionally, or alternatively, the conductive element can be configured such that, when the conductive element is deformed into the second position at a temperature between about room temperature and about half of a melting temperature of the metallic material, a maximum, non-localized, steady-state strain rate in the anchor remains less than about $10^{-12}$ $s^{-1}$. In some cases, the conductive element can be configured such that an initial deformation of the conductive element into the second position induces a first elastic strain in the anchor and, subsequent to being deformed into the second position at a temperature between about room temperature and about half of a melting temperature of the metallic material for a cumulative time of at least $10^7$ seconds, the anchor experiences a maximum, non-local total plastic strain of less than about half of the first elastic strain.

In some embodiments, the metallic material can include an alloy of at least 65 atomic percent nickel and at least 1 atomic percent tungsten, and the conductive element can be configured such that, when the conductive element is deformed between the first and second positions, a stress in the anchor is less than 1000 MPa. In other embodiments, the metallic material can include at least 80 atomic percent gold, and the conductive element can be configured such that, when the conductive element is deformed between the first and second positions, a stress in the anchor is less than 20 MPa.

In some embodiments, the beam can have a length that is less than about 200 times greater than a thickness of the beam and is also less than about 1000 times the separation distance. Further, the contact can be disposed so as to oppose the conductive element over an area defined by an overlap length that is within 20 percent of a free end of the cantilevered beam. The contact and conductive element may be part of a microelectromechanical device or a nanoelectromechanical device, and the conductive element may have a surface area-to-volume ratio that is greater than or equal to $10^3$ $m^{-1}$.

The contact and conductive element can be respectively connected to first and second sides of a circuit, which first and second sides are at different electric potentials. Deformation of the conductive element between the first and second positions may acts to respectively pass and interrupt a current therethrough. The first side can include a power source configured to supply a current of at least 1 mA that oscillates at a frequency less than or equal to about 1 kHz.

In another aspect, a method is provided that includes providing a substrate, forming a contact on the substrate, and forming a conductive element (say, having a surface area-to-volume ratio that is greater than or equal to $10^3$ $m^{-1}$) substantially of metallic material on the substrate. The conductive element can be formed so as to include an anchor extending from the substrate and a beam having an end coupled to the anchor so as to be cantilevered therefrom, the anchor and beam defining an angle therebetween. The conductive element can be deformed, at a temperature between about room temperature and about half of a melting temperature of the metallic material, between a first position, in which the conductive element is separated from the contact by a separation distance, and a second position, in which the conductive element contacts the contact and stores energy, with the conductive element occupying the second position for a cumulative time of at least $10^7$ seconds. Subsequent to the deforming the conductive element, external forces can be removed from the conductive element, such that the conductive element returns to the first position, with the angle varies by less than 0.1 percent. In some embodiments, an electrode can be formed on the substrate, the electrode being configured to establish an electrostatic force configured to urge the conductive element toward the second position. Also, the contact and conductive element can be enclosed between the substrate and a protective cap.

The contact and conductive element can be respectively connected to opposing sides of a circuit, the opposing sides being at different electric potentials when the opposing sides are disconnected. The conductive element can be selectively deformed between the first and second positions so as to respectively pass and interrupt a current therethrough. The method of claim 23, wherein said selectively deforming the conductive element between the first and second position so as to respectively pass and interrupt a current (say, with an amplitude of at least about 1 mA and an oscillation frequency of less than or equal to about 1 kHz) therethrough.

DRAWINGS

These and other features, aspects, and advantages of the present invention will become better understood when the following detailed description is read with reference to the accompanying drawings in which like characters represent like parts throughout the drawings, wherein.

Figure 1:
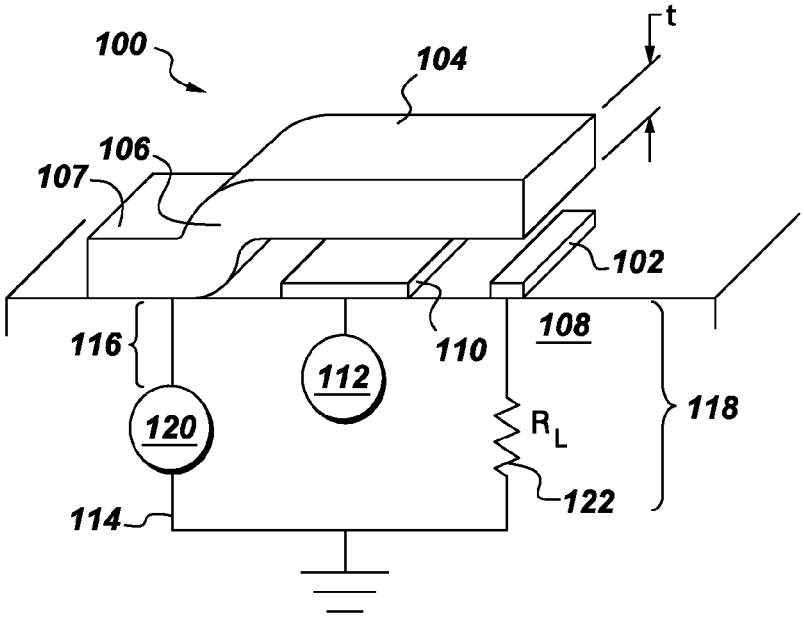
FIG. 1 is a schematic perspective view of a switch structure configured in accordance with an example embodiment.
Figure 6A:
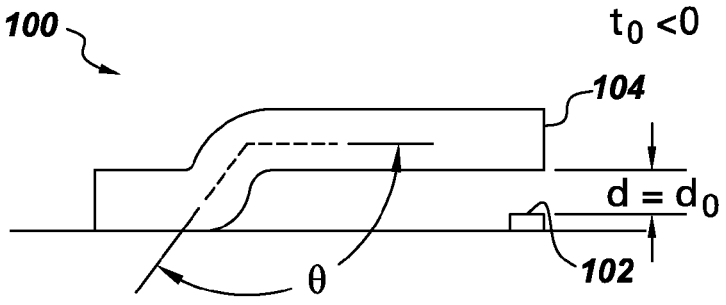
Figure 6B:
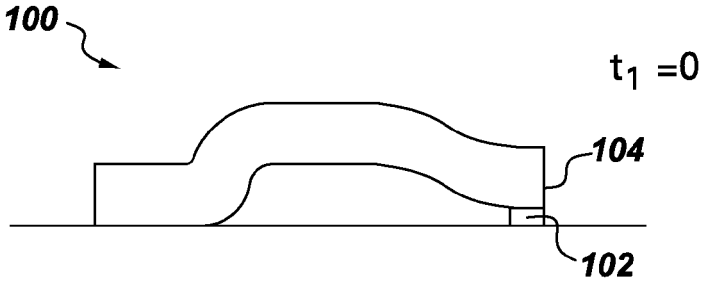
Figure 6C:
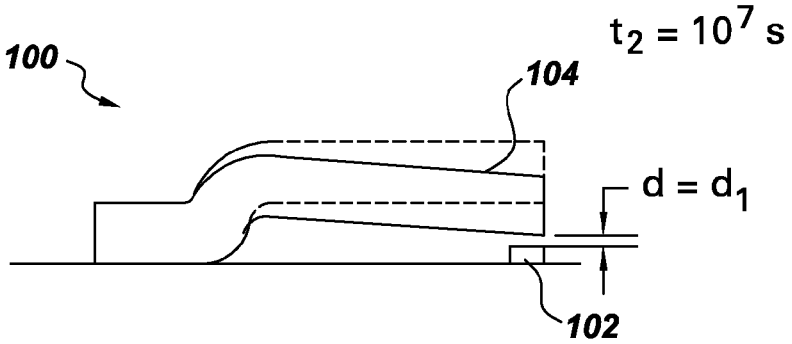
Figure 9:
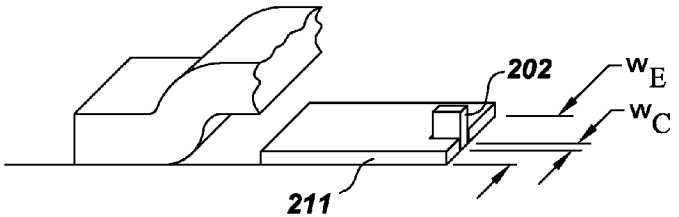
Figure 8:
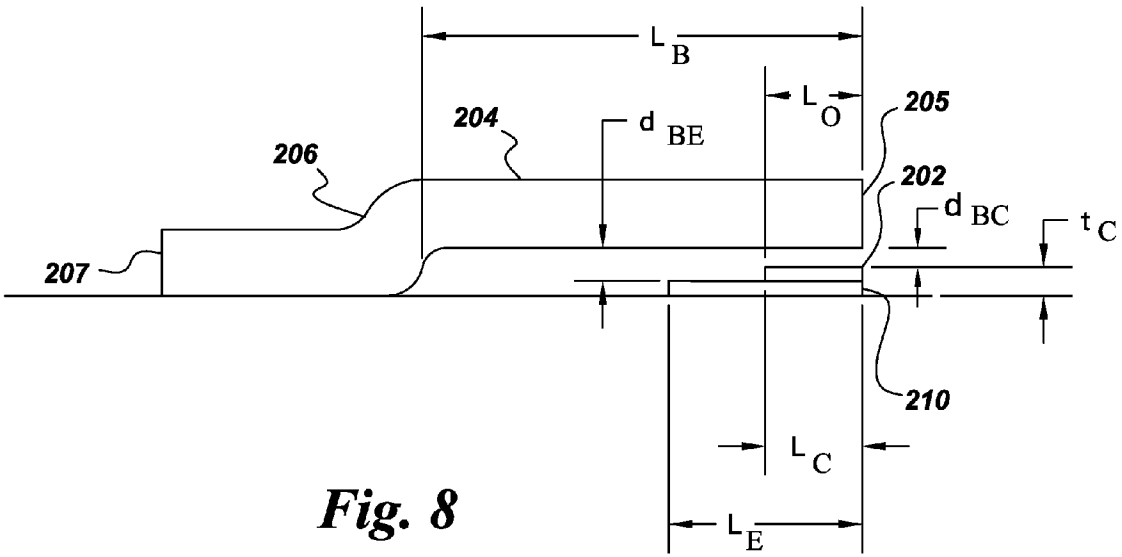
Figure 7:
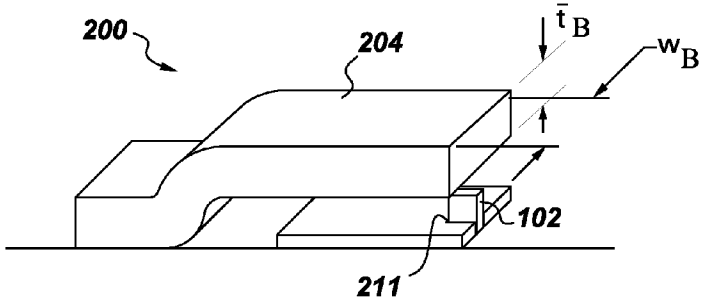
Figure 11:
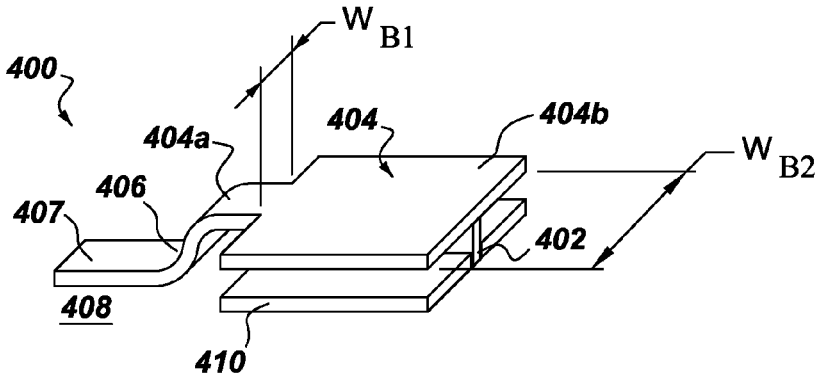
Figure 12:
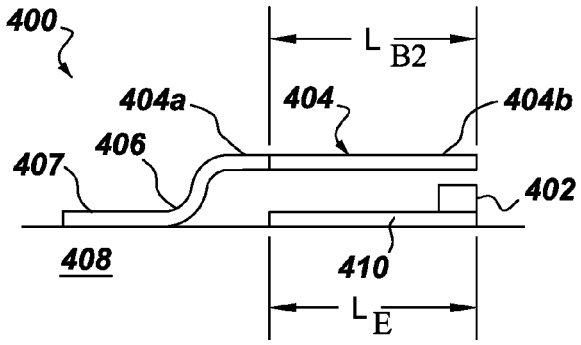
Figure 13:
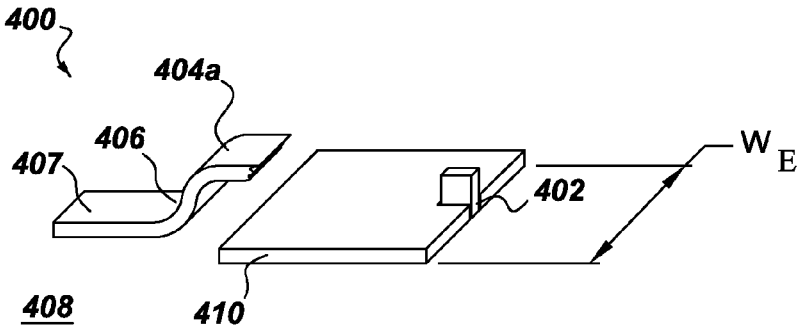
Figure 14:
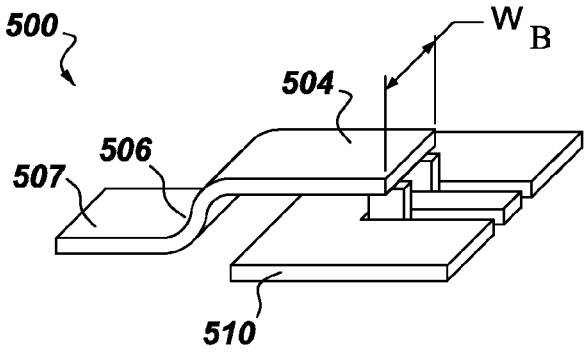
Figure 15:
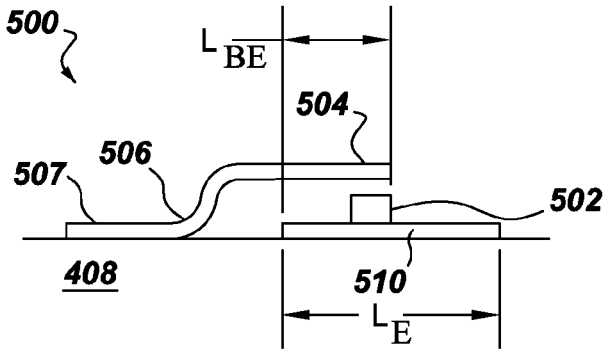
Figure 16:
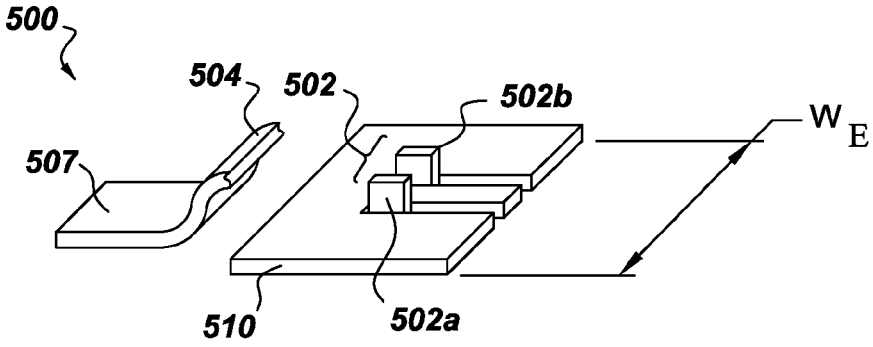
Figure 17:
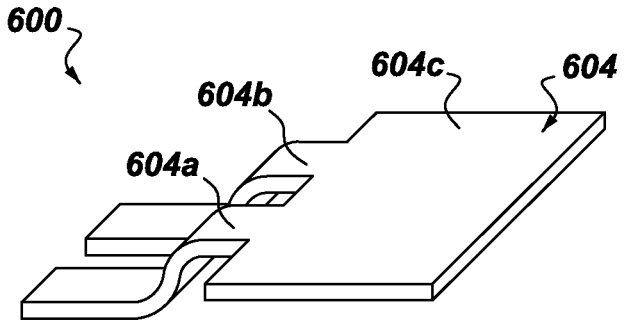
Figure 18:
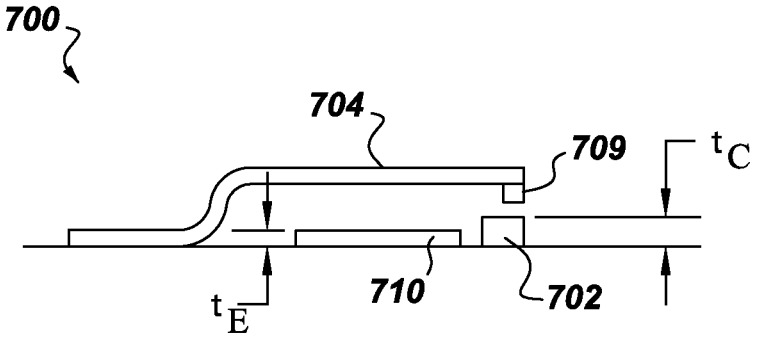

FIGS. 6A-C are side views of the switch structure of FIG. 1 demonstrating the movement of the beam between the contacting and non-contacting positions;

FIG. 7 is a schematic side view of a switch structure configured in accordance with another example embodiment;

FIG. 8 is a schematic side view of the switch structure of FIG. 7;

FIG. 9 is a schematic fragmentary perspective view of the switch structure of FIG. 7;

FIGS. 10A-E are schematic side views representing a process for fabricating a switch structure configured in accordance with an example embodiment;

FIG. 11 is a schematic perspective view of a switch structure configured in accordance with another example embodiment;

FIG. 12 is a schematic side view of the switch structure of FIG. 11;

FIG. 13 is a schematic fragmentary perspective view of the switch structure of FIG. 11;

FIG. 14 is a schematic perspective view of a switch structure configured in accordance with yet another example embodiment;

FIG. 15 is a schematic side view of the switch structure of FIG. 14;

FIG. 16 is a schematic fragmentary perspective view of the switch structure of FIG. 14;

FIG. 17 is a schematic perspective view of a switch structure configured in accordance with still another example embodiment; and FIG. 18 is a schematic side view of a switch structure configured in accordance with yet another example embodiment.

DETAILED DESCRIPTION

Example embodiments of the present invention are described below in detail with reference to the accompanying drawings, where the same reference numerals denote the same parts throughout the drawings. Some of these embodiments may address the above and other needs.

Figure 2:
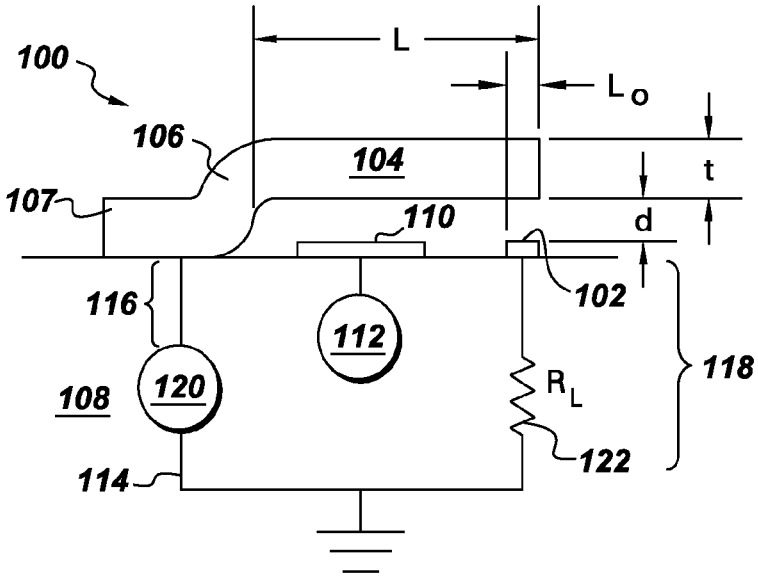
FIG. 2 is a schematic side view of the switch structure of FIG. 1.
Figure 3:
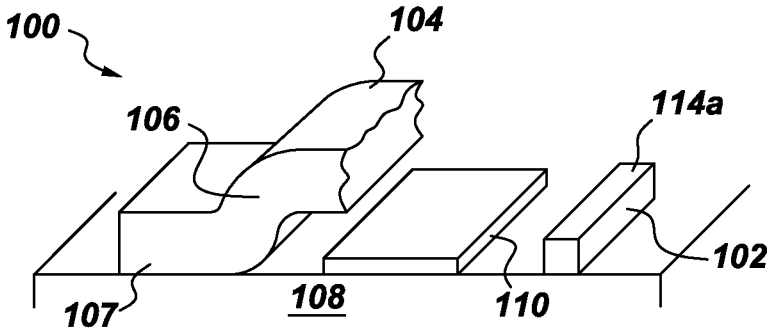
FIG. 3 is a schematic fragmentary perspective view of the switch structure of FIG. 1.
Figure 4:
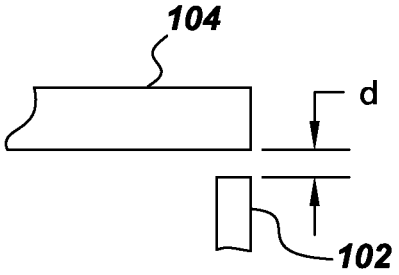
FIG. 4 is a schematic side view of the switch structure of FIG. 1 in an open position.
Figure 5:
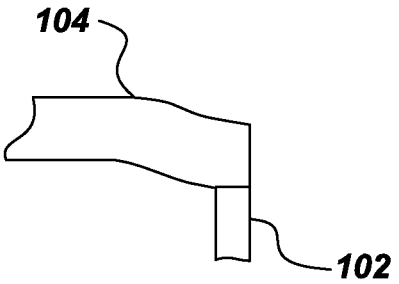
FIG. 5 is a schematic side view of the switch structure of FIG. 1 in a closed position.

Referring to FIGS. 1-3, therein are shown several schematic views of a switch structure 100 configured in accordance with an example embodiment. The switch structure 100 can include a contact 102, which may be, for example, a pad formed, at least partially, of a conductive material (e.g., metal). The switch structure 100 can also include a conductive element, such as a cantilevered beam 104, formed substantially of conductive material (e.g., metal). In some embodiments, the conductive element may also include other features, such as, for example, a protective (and possibly non-conductive) coating on the beam 104 and/or a contact pad, say, disposed over a portion of the beam intended to contact the contact 102 (discussed further below). The beam 104 can be supported by an anchor 106 and a base 107, which may be integrated with the beam and may serve to connect the beam to an underlying support structure, such as a substrate 108. The contact 102 may also be supported by the substrate 108.

Disposing the contact 102 and beam 104 on a substrate 108 may facilitate the production of the switch structure 100 through conventional microfabrication techniques (e.g., electroplating, vapor deposition, photolithography, wet and/or dry etching, etc.). Along these lines, the switch structure 100 may constitute a portion of a microelectromechanical or nanoelectromechanical device or a microelectromechanical system (MEMS). For example, the contact 102 and beam 104 may have dimensions on the order of ones or tens of micrometers and/or nanometers. In one embodiment, the beam 104 may have a surface area-to-volume ratio that is greater than or equal to $10^8$ $m^{-1}$, while in another embodiment the ratio may be closer to $10^3$ $m^{-1}$. Details regarding possible methods for fabricating the switch structure 100 are discussed further below.

The substrate 108 may also include or support conventional semiconductor devices and/or components, such as, for example, metal-oxide-semiconductor field effect transistors (MOSFETs) and patterned conductive layers (not shown) that serve to provide electrical connections thereto and therebetween. Such patterned conductive layers may also provide electrical connections to the contact 102 and beam 104 (the connection to the latter being, for example, through the anchor 106 and base 107), which connections are shown schematically in FIGS. 1 and 2 and described below. The semiconductor devices and conductive layers, like the features of the switch structure 100, can be fabricated using conventional microfabrication techniques. In one embodiment, the substrate 108 may be a semiconductor wafer that has been processed so as to include one or more MOSFETs, with the switch structure 100 and other circuitry formed on a surface of the wafer. The switch structure 100 may be disposed over one of the MOSFETs (e.g., a line normal to the surface of the wafer would intersect both the MOSFET and the switch structure) and may be operable along with the MOSFET (discussed further below). In other embodiments, the substrate 108 may be formed of materials other than semiconductor wafers, including, for example, diamond, sapphire, quartz, polyimide, insulated metal substrates, etc.

Referring to FIGS. 1-5, the beam 104 can be configured to be selectively moveable between a first, non-contacting or "open" position (e.g., FIG. 4), in which the beam is separated from the contact 102 by a separation distance d, and a second, contacting or "closed" position (e.g., FIG. 5), in which the beam comes into contact and establishes electrical communication with the contact. For example, the beam 104 can be configured to undergo deformation when moving between the contacting and non-contacting positions, such that the beam is naturally disposed (i.e., in the absence of externally applied forces) in the non-contacting position and may be deformed so as to occupy the contacting position while storing mechanical energy therein. In other embodiments, the undeformed configuration of the beam 104 may be the contacting position.

The switch structure 100 may also include an electrode 110. When the electrode 110 is appropriately charged, such that a potential difference exists between the electrode and the beam 104, an electrostatic force will act to pull the beam towards the electrode (and also toward the contact 102). By appropriately choosing the voltage to be applied to the electrode 110, the beam 104 can be deformed by the resulting electrostatic force sufficiently to move the beam from the non-contacting (i.e., open or non-conducting) position to the contacting (i.e., closed or conducting) position. Therefore, the electrode 110 may act as a "gate" with respect to the switch structure 100, with voltages (referred to as "gate voltages") applied to the electrode serving to control the opening/closing of the switch structure. The electrode 110 may be in communication with a gate voltage source 112, which gate voltage source may apply a selective gate voltage $V_G$ to the electrode.

The contact 102 and beam 104 may act as part of a circuit 114. For example, the circuit 114 can have a first side 116 and a second side 118 that, when disconnected from one another, are at different electric potentials relative to one another (as where only one of the sides is connected to a power source 120). The contact 102 and beam 104 can be respectively connected to either of the sides 116, 118 of the circuit 114, such that deformation of the beam between the first and second positions acts to respectively pass and interrupt a current therethrough. The beam 104 may be repeatedly moved into and out of contact with the contact 102 at a frequency (either uniform or non-uniform) that is determined by the application within which the switch structure 100 is utilized. When the contact 102 and the beam 104 are separated from one another, a potential difference, and voltage difference, would exist between the contact and beam, and this voltage difference is referred to as the "stand-off voltage."

In one embodiment, the beam 104 may be in communication (e.g., via the anchor 106 and base 107) with the power source 120, and the contact 102 may be in communication with an electrical load 122 presenting, say, a load resistance $R_L$. The power source 120 may be operated at different times as a voltage source and a current source. As such, the beam 104 may act as an electrical switch, allowing a load current (say, with an amplitude greater than or equal to about 1 mA and an oscillation frequency of less than or equal to about 1 kHz) to flow from the power source 120 through the beam and the contact 102 and to the electrical load 122 when the beam is in the contacting position, and otherwise disrupting the electrical path and preventing the flow of current from the power source to the load when the beam is in the non-contacting position. The above-indicated current and switching frequency might be utilized in relatively higher power distribution applications. In other embodiments, such as in applications where the switch structure 100 will be utilized in a signaling context (often operating at relatively lower powers), the power source 120 may provide a current having a magnitude of 100 mA or less (and down to the 1 μA range) with a frequency of oscillation greater than 1 kHz.

The above-described switch structure 100 could be utilized as part of a circuit including other switch structures, whether similar or dissimilar in design, in order to increase the current and voltage capacity of the overall circuit. For example, the switch structures could be arrayed both in series and in parallel in order to facilitate a desired distribution of stand-off voltage when the switch structures are open (e.g., a relatively even distribution of voltage between the switch structures) and a desired distribution of current when the switch structures are closed (e.g., a relatively even distribution of current between the switch structures).

During operation of the switch structure 100, the beam 104 may be subjected to externally applied forces, such as the electrostatic force established by the electrode 110 discussed above, that cause the beam to deform between the first and second positions (i.e., into and out of contact with the contact 102). These forces may be applied, and the switch structure 100 may operate, at ambient temperatures (use temperatures) from room temperature up, but often less than 50 percent or even 30 percent of the melting temperature of the material(s) from which the beam is substantially formed. Further, for applications in which the switch structure 100 is expected to possess a useful lifetime on the order of years (e.g., relatively higher power distribution applications), the beam 104 may remain in contact with the contact 102 for a cumulative time of at least $10^4$ seconds, and in some cases for more than $10^6$ seconds or even $10^8$ seconds. Still further, when deformed so as to contact the contact 102, the beam 104 may experience relatively high stresses, the magnitude of the stresses depending on the geometry of the switch structure 100 and the material from which the beam is substantially formed.

As one example of the above, the switch structure 100 can include a cantilevered beam 104 of nickel (Ni)-12 atomic percent tungsten (W) with a length L of about 100 μm, an aspect ratio (length L to thickness t) of about 25 to 1, and a separation distance d from the contact 102 of about 1-3 μm, where the contact is located opposite the free end of the beam and overlaps the beam by a distance $L_o$. For such geometry, a stress of more than 100 MPa, and as much as 600 MPa or more, may be present in substantial portions of the beam 104 and/or anchor 106 when the beam is deformed so as to contact the contact 102. As mentioned earlier, in some applications, the beam 104 and/or anchor 106 may be required to sustain this stress for a time that may be as long or longer than $10^4$ seconds, or even $10^8$ seconds, under use conditions, without failure. These stresses are expected to be separate from the highly localized, and often transient, stresses that may be present around stress concentration regions, such as around geometrical irregularities, surface asperities, and defects.

For proper operation of a switch structure (such as the switch structure 100) including a cantilevered beam (or other deformable contacting structure) and associated contact, it is often intended that the beam assume either the contacting position or the non-contacting position as specified by the presence or absence of an external force urging the beam into contact with the contact (e.g., the presence or absence of the gate voltage associated with the electrode 110 and the corresponding electrostatic force). However, a variety of investigators have observed that switch structures including a metallic, micrometer-scale cantilevered beam (or other deformable contacting structure) tend to malfunction, such that the behavior of the switch structure is not as intended. These malfunctions are generally attributed to surface adhesion-related issues. Specifically, in light of the large surface area-to-volume ratio present in a micrometer-scale beam (or other deformable contacting structure), the energy reduction associated with the elimination of free surface where the beam contacts the associated contact pad may be non-trivial or even higher relative to the mechanical energy stored in the beam during deformation. As such, theory has it, the cantilevered beam and associated contact remain adhered following the removal of the external force otherwise urging the two into contact, as the internal strain energy of the beam is insufficient to induce separation of the beam from the contact.

In contrast to the prevailing theories, Applicants have observed that failure of switch structures including metallic, small-scale cantilevered beams is often due not to adhesion of the beam and an associated contact, but mainly to a change in the undeformed configuration of the beam. That is, as an external force is applied to urge the beam into contact with the associated contact, the beam undergoes time-dependent plastic deformation, also referred to as "creep."

As the beam undergoes time-dependent plastic deformation, the undeformed configuration of the beam (i.e., the shape the beam assumes in the absence of an external load) moves from that with the beam disposed in the non-contacting position towards a configuration in which the beam is disposed in the contacting position. Similarly, the mechanical strain energy initially associated with the beam when in the contacting position is reduced, in some cases to nearly zero. Ultimately, the switch structure may fail due to adhesion between the beam and the associated contact, but this failure mechanism may be secondary, and due, to the reduction in the mechanical strain energy associated with the beam in the contacting position. The time-dependent plastic deformation of the beams associated with switch structures is surprising, in that these devices are often operating at ambient temperatures under 50 percent or even 30 percent of the melting temperature of the metallic material from which the beam is formed (or, if the beam is formed of multiple discrete metallic materials, temperatures under 50 percent or even 30 percent of the minimum melting temperature associated with one of the metals constituting a substantial part of the beam).

In view of Applicants' discovery, the beam 104 may be configured so as to limit, under use conditions including temperatures under 50 percent or even 30 percent of the minimum melting temperature associated with one of the metals constituting a substantial part of the beam, permanent deformation of the beam due to time-dependent plastic deformation of the metallic material from which the beam is substantially formed. It is noted that the beam 104 can be considered to be "formed substantially" of metallic material when the mechanical behavior of the beam is generally or significantly determined by the mechanical behavior of constituent metallic material. During operation of the switch structure 100, the beam 104 can at times be disposed in the first (non-contacting) position, in which the beam is separated from the contact 102 by a separation distance d. At other times, the beam 104 can be disposed in the second (contacting) position, in which the beam comes into contact the contact 102. The beam 104 may be deformed into the second (closed) for a cumulative time of at least $10^7$ seconds and at a temperature between room temperature and about half of the melting temperature of the metallic material (or, where the metallic material includes multiple discrete metallic materials, the melting temperature of one of the metallic materials from which the beam is substantially formed). The beam 104 may be geometrically configured such that, subsequent to such deformation, the separation distance d between the beam 104 and the contact 102, in the absence of external forces, varies by less than 20 percent over the cumulative time (that is, measurements of d taken at any time over the cumulative time would yield a result that is within 20 percent of one another).

For example, referring to FIGS. 6A-C, at time $t_0<0$, the beam 104 can be disposed in the first (non-contacting) position, in which the beam is separated from the contact 102 by a separation distance $d=d_0$. A force F can then be applied to the beam 104 at time $t_1=0$ in order to deform the beam into the second (contacting) position, such that the beam comes into contact the contact 102. The beam 104 can then be maintained in the second position until a time $t_2=10^7$ seconds, at which point the force F can be removed. As the force F is removed, the beam 104 can resume the first position, being separated from the contact 102 by a separation distance $d=d_1$.

Where the stresses experienced by the beam 104 are less than the stress necessary to cause plastic deformation of the metallic material from which the beam is substantially formed, and where the beam is completely free from the effects of time-dependent plastic deformation, $d_0=d_1$. Similarly, it is expected that the magnitude of the force F that is required to maintain the beam 104 in the second position, and the amount of mechanical energy stored in the beam when disposed in the second position, would remain constant. However, due to time-dependent plastic deformation, Applicants have found that $d_1$ is often less than $d_0$. Still, the beam 104 can be configured so as to assure that the separation distance d between the contact 102 and the beam is sufficient to allow the switch structure 100 to function properly.

For example, the beam 104 can be configured so as to assure that $d_0 \geq d_1 \geq 0.8d_0$. Additionally, or alternatively, the beam 104 can be configured to store energy during deformation sufficient to cause the beam to substantially assume the first position (e.g., within 20 percent) in the absence of external forces. Further, the beam 104 and the anchor 107 may define an angle θ therebetween, and the beam 104 can be configured such that the angle θ, in the absence of external forces acting on the beam, varies by less than 0.5 percent, and in some cases less than 0.1 percent, as a result of the beam being deformed between the first and second positions.

Applicants have further discovered that, for switch structures including a cantilevered beam, for example, as shown in FIG. 1, time dependent plastic deformation in the anchor of the beam (or the structure from which the beam is otherwise cantilevered) can be a significant cause for a permanent change of configuration of the overall beam. As such, the beam 104 can be configured such that, when the beam is deformed into the second position, a maximum, non-localized, steady-state strain rate in the anchor remains less than about $10^{-12}$ $s^{-1}$. Alternatively, or additionally, the beam 104 can be configured such that the total plastic strain experienced by the anchor 106 remains less than some percentage of the elastic strain induced in the anchor upon initial deformation of the beam into the contacting position (prior to any significant creep in the beam). For example, if an initial deformation of the beam 104 into the second position induces a first elastic strain in the anchor 106, and thereafter the beam is deformed into the second position for a cumulative time of at least $10^7$ seconds, the beam can be configured such that the anchor experiences a maximum, non-local total plastic strain of less than about half of the first elastic strain.

The beam 104 can be designed so as to limit the stress realized in the anchor 106 during deformation of the beam to below a threshold above which excessive plastic deformation would be realized. This threshold stress would depend on one or more of the temperature at which the beam 104 is deformed, the amount of shape change of the beam that can be tolerated within an application, and the material(s) from which the beam is substantially formed (including both the composition and the microstructure of the material(s)).

For example, for applications in which the switch structure 100 operates at a temperature less than about half the melting temperature of the material(s) from which the beam 104 is substantially formed, Applicants have found that acceptable performance (e.g., a change in the separation distance between the beam and contact of less than 20 percent over a cumulative time of deformation of $10^7$ seconds or even up to $10^8$ seconds) can be achieved when the stress in a non-localized portion of the anchor (i.e., away from a highly localized stress concentration region) is less than 1000 MPa for a beam for which the constituent metallic material includes an alloy of at least 65 atomic percent nickel and at least 1 atomic percent tungsten. As another example, Applicants have found that acceptable performance over time spans of one and 20 years can be achieved when the stress in a non-localized portion of the anchor (i.e., away from a highly localized stress concentration region) is less than 45 and 20 MPa, respectively, for a beam for which the constituent metallic material includes 80 atomic percent gold and 20 atomic percent nickel. Applicants have also found that, for beams formed of pure gold, acceptable performance over a time span of one year can be achieved when the stress in a non-localized portion of the anchor is less than 25 MPa.

Overall, the beam 104 can be designed so as to limit stresses and/or plastic strains in the anchor 106. For example, referring to FIGS. 7-9, a switch structure 200 can include a contact 202 and a conductive element, such as a cantilevered beam 204, formed substantially of conductive material (e.g., metal). The beam 204 can be supported by an anchor 206 and a base 207, which may be integrated with the beam and may serve to connect the beam to an underlying support structure, such as a substrate 208. The contact 202 may also be supported by the substrate 208. The switch structure 200 may also include an electrode 210 configured to actuate the beam 204.

A variety of physical and/or design parameters may affect the stresses in the anchor 206. The switch structure 200 may be characterized, for example, by a beam length $L_B$, a beam width $w_B$, a beam thickness $t_B$, a contact length $L_C$, a contact width $w_C$, a contact thickness $t_C$, a beam-contact separation distance (in the absence of external forces) $d_{BC}$, a beam-electrode overlap length $L_E$ (measured from the end 205 of the beam 204), an electrode width $w_E$, a beam-electrode separation distance (in the absence of external forces) $d_{BE}$, a beam material or materials (and the corresponding material properties), and a maximum voltage difference $V_{max}$ between the beam and the electrode 210. By appropriately selecting values for these parameters (in conjunction with the selection of the material of the beam 204 and the expected operational temperatures), Applicants have found that switch structures can be produced for which stresses in the area of the anchor 206 are sufficiently low to enable operational lifetimes for the switch structure 200 of upwards of one or even 20 years.

In some embodiments, the thickness $t_B$ of the beam 204 can be at least 1 μm. A thickness $t_B$ of about 1 μm or more may limit subsequent deformation of the beam due to subsequent processing at elevated temperatures. The length $L_B$ of the beam 204 can be at least about 20 μm. The contact 202 can be disposed so as to oppose the beam 204 over an area defined by an overlap length $L_o$ that is within 20 percent of a free end 205 of the beam. The electrode 210 may be disposed within 50 percent of the free end 205 of the beam 204, and in some embodiments within 20-30 percent of the free end.

The beam 204 can have a length $L_B$ that is less than about 200 times greater than the thickness $t_B$ and is also less than about 1000 times the separation distance $d_{BC}$ between the beam and the associated contact 202. Where the beam 204 has a larger aspect ratio and/or is separated from the contact 202 by a smaller distance, the stress induced in the beam when deformed into the contacting position may be relatively low. However, as the length of the beam 204 is increased, the number of beams that can be placed in a given area will decrease. Further, as the separation distance $d_{BC}$ is reduced, failure mechanisms other than creep-related deformation may become significant. For example, as the beam 204 and contact 202 approach one another, the attractive force therebetween increases for a given voltage difference, and this attractive force could become large enough to cause the beam to unintentionally assume the contacting position (e.g., even in the absence of a voltage at the electrode 210). Also, the area between the beam 204 and the contact 202 may be more likely to experience electrical breakdown due to, for example, field emission.

By configuring the beam 104, 204 so as to avoid significant creep during use, the separation distance $d_{BC}$ between the beam and the contact 102, 202 can be maintained fairly constant, say, within 20 percent of its initial value, for a time in use of up to 1 year and in some cases upwards of 20 years (a requirement for some applications). In other words, for each instance in which the beam 104, 204 is urged from the non-contacting position (in which the beam is separated from the contact 102, 202 by a distance $d_{BC}$) and toward the contacting position by an applied force and then the applied force is removed, the beam will substantially return to the non-contacting position such that the beam is separated from the contact by the distance $d_{BC}$, where the value of $d_{BC}$ varies by less than 20 percent.

By appropriately selecting values for the various design parameters of the switch structure 200 (in conjunction with the selection of the material of the beam 204 and the expected operational temperatures), Applicants have found that switch structures can be produced for which stresses in the area of the anchor 206 are sufficiently low to enable operational lifetimes (e.g., a change in the separation distance between the beam 204 and contact 202 of less than 20 percent) for the switch structure 200 of upwards of one or even 20 years. The table below provides several combinations of parameter values, operational temperatures, and beam materials for which Applicants have observed acceptable performance.

| parameter | Au beam | Ni-12 atomic % W beam |
|---|---|---|
| operational lifetime (years) | 20 | 20 |
| operational temperature (° C.) | 80 | 200 |
| $L_B$ (μm) | 190 | 95 |
| $t_B$ (μm) | 7 | 3 |

-continued

| parameter | Au beam | Ni-12 atomic % W beam |
|---|---|---|
| $t_C$ (μm) | 0.3 | 0.3 |
| $d_{BC}$ (μm) | 0.4 | 1 |
| $L_E/L_B$ | 0.2 | 0.2 |
| $V_{max}$ (V) | 21 | 120 |

The process temperatures associated with the production of the above described switch structure 100 formed substantially of metallic material are moderate, usually less than 450° C. This is in contrast to the temperatures required to form a conductor from silicon, which, when employing a conventional doping procedure, are usually greater than 900° C. The lower processing temperatures associated with the switch structure 100 may facilitate the integration of the switch structure with temperature-sensitive components, such as, for example, MOSFETs.

Figure 10A:
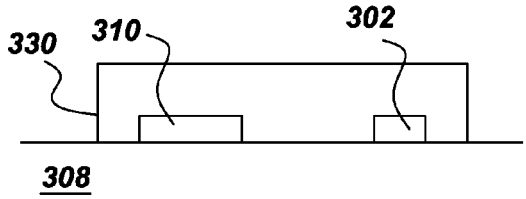
Figure 10B:
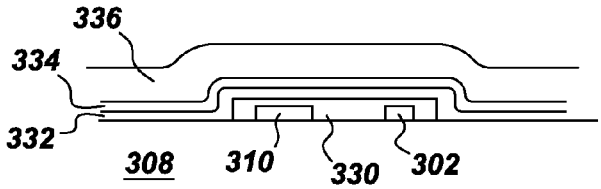
Figure 10C:
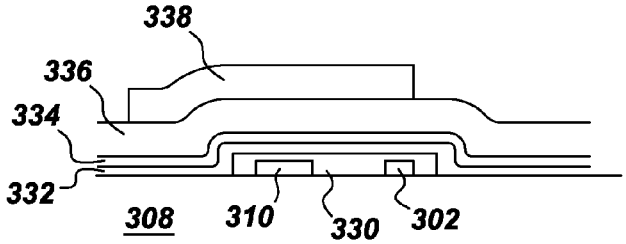
Figure 10D:
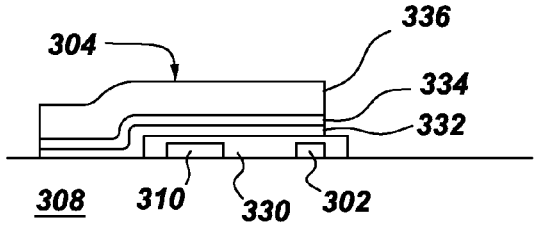
Figure 10E:
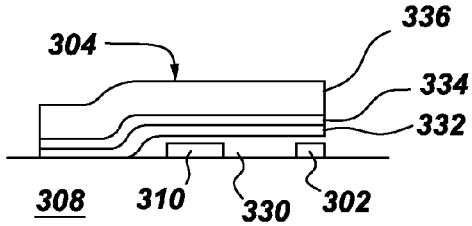

As mentioned above, switch structures as described above, such as the switch structure 100 of FIG. 1, can be fabricated on substrates using conventional microfabrication techniques. For example, referring to FIGS. 10A-E, therein is shown a schematic representation of a fabrication process for producing a switch structure configured in accordance with an example embodiment. First, a substrate 308 can be provided with an electrode 310 and a contact 302 disposed thereon. Silicon dioxide 330 can then be deposited, for example, by vapor deposition, and patterned so as to encapsulate the electrode 310 and contact 302 (FIG. 10A). A thin adhesion layer 332 (e.g., titanium), a seed layer 334 (e.g., gold), and a metal layer 336 (e.g., Ni-4 atomic percent W) can then be deposited via electroplating (FIG. 10B). Photoresist 338 could then be applied and patterned using conventional photolithography (FIG. 10C), after which the metal, seed, and adhesion layers 336, 334, 332 could be etched to form a beam 304 and the photoresist subsequently removed (FIG. 10D). Finally, the silicon dioxide 330 supporting the beam 304 and encapsulating the electrode 310 and contact 302 could be removed (FIG. 10E). Thereafter, the beam 304 may also be enclosed by a protective cap, for example, at a temperature of about 300-450° C.

Referring to FIGS. 11-13, therein are shown several views of a switch structure 400 configured in accordance with another example embodiment. The switch structure can include a contact 402 and a conductive element, such as a cantilevered beam 404, formed substantially of conductive material (e.g., metal). The beam 404 can be supported by an anchor 406 and a base 407, which may be integrated with the beam and may serve to connect the beam to an underlying support structure, such as a substrate 408. The switch structure 400 may also include an electrode 310 configured to actuate the beam 404. The beam 404 may include a first beam portion 404*a* having a width $w_{B1}$ and a second beam portion 404*b* having a width $w_{B2}>w_{B1}$. The electrode 410 can have a width $w_E$, which width may be roughly equal to $w_{B2}$. In this way, the actuating force provided by the electrode 410 can be modulated by modulating the corresponding widths of the second beam portion 404*b* and the electrode. The second beam portion 404*b* may also have a length $L_{B2}$ that is roughly equal to the length $L_E$ of the electrode 410.

Referring to FIGS. 14 and 15, therein are shown several views of a switch structure 500 configured in accordance with another example embodiment. The switch structure can include a contact 502 and a cantilevered beam 504 supported by an anchor 506 and a base 507. The switch structure 500 may also include an electrode 510 configured to actuate the beam 504. The beam 504 can have a width $w_B$, and the electrode 510 can have a width $w_E$ that may be different from the width of the beam. Where $w_E>w_B$ the electrostatic force produced by the electrode 510 and acting on the beam 504 may cause efficient actuation of the beam, possibly lowering the energy required to actuate the beam. The contact 502 may include several discrete contact structures 502*a*, 502*b*, and the beam 504 may provide electrical current to each contact structure in parallel or from one to the other in series.

Referring to FIG. 17, in some embodiments, a switch structure 600 may include a conductive element 604 that has multiple first cantilever portions 604*a*, 604*b* connected to a common second beam portion 604*c*. Referring to FIG. 18, a switch structure 700 may include an opposing contact 702 and beam 704. The beam 704 may include a protrusion 709 configured to make contact with the contact 702 as the beam is actuated. Such configurations of the beam 704 may facilitate a contact 702 that has a thickness $t_C$ about equal to the thickness $t_E$ of an associated electrode 710.

While only certain features of the invention have been illustrated and described herein, many modifications and changes will occur to those skilled in the art. For example, while the conductive element of the switch structure 100 of FIG. 1 has been exemplified by a cantilevered beam, other deformable contact structures are also possible, including, for example, a fixed-fixed beam, a torsional element, and/or a diaphragm. Further, while the above description involved a beam having a monolithic metallic layer configured to inhibit time-dependent deformation, other embodiments may include a beam that is substantially formed of multiple layers of metallic material, with each (or most) of the layers being configured to inhibit time-dependent deformation. It is, therefore, to be understood that the appended claims are intended to cover all such modifications and changes as fall within the true spirit of the invention.

What is claimed:

1. A device comprising:

a substrate;

a contact disposed on said substrate; and a single-piece structure arranged both as an electrically conductive element and a structural element, disposed on said substrate and composed substantially of metallic material so that a singular time-dependent plastic deformation of the single-piece structure is substantially determined by the time-dependent plastic deformation of constituent metallic material of the single-piece structure, said single-piece structure being configured to be deformable between a first position in which said structure is separated from said contact by a separation distance and a second position in which said single-piece structure contacts said contact and stores mechanical energy, wherein said single-piece structure is configured such that, subsequent to being deformed into the second position at a temperature between about room temperature and about half of a melting temperature of said metallic material for a cumulative time of at least $10^7$ seconds, the separation distance in the absence of external forces varies by less than 20 percent over the cumulative time.

2. The device of claim 1, wherein said single-piece structure establishes electrical communication with said contact when in the second position.

3. The device of claim 1, wherein said single-piece structure comprises a structure selected from the group consisting of a cantilever, a fixed-fixed beam, a torsional element, and a diaphragm.

4. The device of claim 1, further comprising an electrode disposed on said substrate and configured to be charged so as to apply an electrostatic force configured to urge said single-piece structure toward the second position.

5. The device of claim 1, wherein said single-piece structure is configured to store energy during deformation sufficient to cause said single-piece structure to substantially assume the first position in the absence of external forces.

6. The device of claim 1, wherein said contact and said single-piece structure are part of a microelectromechanical device or a nanoelectromechanical device.

7. The device of claim 1, wherein said single-piece structure has a surface area-to-volume ratio that is greater than or equal to $10^3$ $m^{-1}$.

8. The device of claim 1, further comprising a circuit having a first side and a second side at different electric potentials, wherein said contact and single-piece structure are respectively connected to one and the other of said first and second sides of said circuit, such that deformation of said single-piece structure between the first and second positions acts to respectively pass and interrupt a current therethrough.

9. The device of claim 8, wherein said first side includes a power source configured to supply a current of at least 1 mA that oscillates at a frequency less than or equal to about 1 kHz.

10. The device of claim 1, wherein said single-piece structure includes an anchor extending from said substrate and having an end coupled to said anchor so as to be cantilevered therefrom.

11. The device of claim 10, wherein said single-piece structure and said anchor define therebetween an angle, and wherein said single-piece structure is configured such that, subsequent to being deformed into the second position at a temperature between about room temperature and about half of a melting temperature of said metallic material for a cumulative time of at least $10^7$ seconds, the angle in the absence of external forces varies by less than 0.1 percent.

12. The device of claim 10, wherein said single-piece structure is configured such that, when said single-piece structure is deformed into the second position at a temperature between about room temperature and about half of a melting temperature of said metallic material, a maximum, non-localized, steady-state strain rate in said anchor remains less than about $10^{-12}$ $s^{-1}$.

13. The device of claim 10, wherein said single-piece structure is configured such that an initial deformation of said single-piece structure into the second position induces a first elastic strain in said anchor and, subsequent to being deformed into the second position at a temperature between about room temperature and about half of a melting temperature of said metallic material for a cumulative time of at least $10^7$ seconds, said anchor experiences a maximum, non-local total plastic strain of less than about half of the first elastic strain.

14. The device of claim 10, wherein said metallic material includes an alloy of at least 65 atomic percent nickel and at least 1 atomic percent tungsten and said single-piece structure is configured such that, when said single-piece structure is deformed between the first and second positions, a stress in said anchor is less than 1000 MPa.

15. The device of claim 10, wherein said metallic material includes at least 80 atomic percent gold and said single-piece structure is configured such that, when said single-piece structure is deformed between the first and second positions, a stress in said anchor is less than 20 MPa.

16. The device of claim 10, wherein said single-piece structure comprises a beam having a length and a thickness, and wherein the length is less than about 200 times greater than the thickness and is less than about 1000 times the separation distance.

17. The device of claim 16, wherein said contact is disposed so as to oppose said single-piece structure over an area defined by an overlap length that is within 20 percent of a free end of said beam.

18. A method comprising:

providing a substrate;

forming a contact on the substrate;

arranging at least one single-piece structure both as an electrically conductive element and a structural element;

forming the single-piece structure substantially of metallic material on the substrate so that a singular time-dependent plastic deformation of the single-piece structure is substantially determined by the time-dependent plastic deformation of constituent metallic material of the single-piece structure, the single-piece structure including an anchor extending from the substrate and having an end coupled to the anchor so as to be cantilevered therefrom, the anchor and the single-piece structure defining an angle therebetween;

deforming the single-piece structure, at a temperature between about room temperature and about half of a melting temperature of the metallic material, between a first position, in which the single-piece structure is separated from the contact by a separation distance, and a second position, in which the single-piece structure contacts the contact and stores energy, the single-piece structure occupying the second position for a cumulative time of at least $10^7$ seconds; and subsequent to said deforming the single-piece structure, removing external forces from the single-piece structure, such that the single-piece structure returns to the first position and the angle varies by less than 0.1 percent.

19. The method of claim 18, further comprising forming an electrode on the substrate, the electrode being configured to establish an electrostatic force configured to urge the single-piece structure toward the second position.

20. The method of claim 18, wherein said forming a single-piece structure on the substrate includes forming a single-piece structure having a surface area-to-volume ratio that is greater than or equal to $10^3$ $m^{-1}$.

21. The method of claim 18, further comprising enclosing the contact and single-piece structure between the substrate and a protective cap.

22. The method of claim 18, wherein said forming a single-piece structure substantially of metallic material includes forming a single-piece structure substantially of an alloy of at least 65 atomic percent nickel and at least 1 atomic percent tungsten.

23. The method of claim 18, further comprising:

respectively connecting the contact and single-piece structure to opposing sides of a circuit, the opposing sides being at different electric potentials when the opposing sides are disconnected; and selectively deforming the single-piece structure between the first and second positions so as to respectively pass and interrupt a current therethrough.

24. The method of claim 23, wherein said selectively deforming the single-piece structure between the first and second position so as to respectively pass and interrupt a current therethrough includes selectively deforming the single-piece structure between the first and second positions so as to respectively pass and interrupt a current with an amplitude of at least about 1 mA and an oscillation frequency of less than or equal to about 1 kHz.

25. The method of claim 18, wherein said forming a single-piece structure includes forming a beam having a length and a thickness, and wherein the length is less than about 200 times greater than the thickness and is less than about 1000 times the separation distance.

26. The method of claim 25, wherein said forming a contact and single-piece structure includes forming a contact so as to oppose the single-piece structure over an area defined by an overlap length that is within 20 percent of a free end of the cantilevered beam.

27. A device comprising:

a substrate;

a contact disposed on said substrate; and single-piece structure arranged both as an electrically conductive element and a structural element disposed on said substrate and composed substantially of metallic material having a singular time-dependent plastic deformation, said single-piece structure being configured to be deformable between a first position in which said single-piece structure is separated from said contact by a separation distance and a second position in which said single-piece structure contacts said contact and stores mechanical energy, wherein said single-piece structure is configured such that, subsequent to being deformed into the second position at a temperature between about room temperature and about half of a melting temperature of said metallic material for a cumulative time of at least $10^7$ seconds, the separation distance in the absence of external forces applied to the single-piece structure varies by less than 20 percent over the cumulative time, wherein the amount of mechanical energy which remains stored in said single-piece structure for the cumulative time is sufficient to cause the single-piece structure to substantially assume the first position from the second position.

* * * * *